US012781458B2

(12) United States Patent
Bradac

(10) Patent No.: US 12,781,458 B2
(45) Date of Patent: Nov. 3, 2026

(54) CONCRETE FORMING TUBE

(71) Applicant: James M. Bradac, Hudson, WI (US)

(72) Inventor: James M. Bradac, Hudson, WI (US)

( * ) Notice: Subject to any disclaimer, the term of this patent is extended or adjusted under 35 U.S.C. 154(b) by 1019 days.

(21) Appl. No.: 17/363,321

(22) Filed: Jun. 30, 2021

(65) Prior Publication Data

US 2023/0002995 A1 Jan. 5, 2023

(51) Int. Cl.

| | |
|---|---|
| ***E02D 5/66*** | (2006.01) |
| ***E02D 5/38*** | (2006.01) |
| ***E02D 15/04*** | (2006.01) |
| ***E04G 13/02*** | (2006.01) |

(52) U.S. Cl.

CPC ..... *E02D 5/665* (2013.01); *E02D 5/38* (2013.01); *E02D 15/04* (2013.01); *E04G 13/021* (2013.01)

(58) Field of Classification Search

CPC ..... E02D 5/665; E02D 5/38; E02D 15/04; E02D 5/34; E02D 29/12; E04G 13/021

USPC ..... 138/121, 173; 249/48

See application file for complete search history.

(56) References Cited

U.S. PATENT DOCUMENTS 951,668 A * 3/1910 Welsh ..... E02D 5/385 405/245
1,778,925 A * 10/1930 Thornley ..... E02D 5/72 405/253
1,858,512 A * 5/1932 Langenberg ..... E04C 3/34 428/602
2,922,255 A * 1/1960 Broderick ..... C03B 19/02 164/385
3,279,196 A * 10/1966 Dougherty ..... E02D 5/385 405/253
3,374,634 A * 3/1968 Fochler ..... F16L 9/127 138/DIG. 7
3,421,271 A * 1/1969 Whitfield ..... E04B 1/3511 52/745.03
3,566,607 A * 3/1971 Sixt ..... E02B 11/005 138/121
3,581,449 A * 6/1971 Huber ..... E04H 12/00 52/84
3,731,711 A * 5/1973 Bauer ..... F16L 9/06 138/121
3,736,757 A * 6/1973 Hartzell ..... E02D 5/48 405/242
3,785,607 A * 1/1974 Worker ..... E04G 13/02 249/161
3,878,685 A * 4/1975 Schmunk ..... F16L 11/111 138/121
3,889,839 A * 6/1975 Simon ..... B65D 39/084 220/675
3,985,257 A * 10/1976 Shaffer ..... B65D 39/082 220/672
4,171,791 A * 10/1979 Britz ..... B28B 7/16 249/168

(Continued)

OTHER PUBLICATIONS

DIY Chatroom, https://www.diychatroom.com/threads/help-with-concrete-forms-need-verification.509033/ (Year: 2017).*

*Primary Examiner* — Gisele D Ford
(74) *Attorney, Agent, or Firm* — SHERRILL LAW OFFICES, PLLC

(57) ABSTRACT

A large diameter single-piece thermoplastic concrete forming tube with axially spaced and integrally formed fully encircling circumferentially continuous radially rigidifying ribs, and method of forming a concrete column employing the tube.

13 Claims, 5 Drawing Sheets

(56) References Cited

U.S. PATENT DOCUMENTS 4,257,527 A * 3/1981 Snyder ..... B65D 1/16 220/675
4,618,287 A * 10/1986 Kinnan ..... E02D 27/42 52/514
4,650,367 A * 3/1987 Dietzler ..... F16L 9/18 138/172
4,887,789 A * 12/1989 Harris ..... E04G 13/02 249/134
4,921,116 A * 5/1990 Troughton ..... B65D 1/40 413/1
4,925,049 A * 5/1990 Przytulla ..... B65D 1/16 220/675
5,182,885 A * 2/1993 Barton, Jr. ..... F16L 5/10 52/98
5,255,888 A * 10/1993 Workman ..... E04G 13/021 249/168
5,543,107 A * 8/1996 Malik ..... B29C 49/0411 425/525
5,755,353 A * 5/1998 Zampella ..... B65D 7/045 220/619
6,129,482 A * 10/2000 Ditullio ..... E02B 11/005 405/36
6,176,055 B1 * 1/2001 Fu ..... E02D 27/16 52/167.9
6,189,286 B1 * 2/2001 Seible ..... E04C 3/44 52/834
6,189,717 B1 * 2/2001 Versaw, Jr. ..... E02D 29/124 220/795
7,737,222 B2 * 6/2010 Backman ..... C08F 210/16 526/348
9,566,748 B2 * 2/2017 Chou ..... E04C 5/07
10,024,018 B2 7/2018 Bradac
2005/0061382 A1 * 3/2005 Chenin ..... F16L 9/045 138/121
2006/0162799 A1 * 7/2006 Goddard ..... F16L 11/20 138/121
2007/0077122 A1 * 4/2007 Birchler ..... E03F 1/003 405/48
2007/0295422 A1 * 12/2007 Ostan ..... F16L 55/041 138/119
2009/0020680 A1 * 1/2009 Bradac ..... E02D 5/38 249/98
2014/0182226 A1 * 7/2014 Habodasz ..... E04C 3/30 52/309.1
2020/0223124 A1 * 7/2020 Gurvich ..... B29C 70/42
2021/0262597 A1 * 8/2021 Chen ..... F16L 11/115

* cited by examiner

CONCRETE FORMING TUBE

FIELD OF INVENTION

This invention relates to concrete forms for posts, piers, footings and other structural pillars.

BACKGROUND

Concrete posts, piers, footings and other structural pillars are a common component of infrastructure ranging from footings for decks and bridges to columns in multi-story buildings.

These posts, piers, footings and other structural pillars are constructed by pouring concrete into a form. Typically a tubular form is used. Tubular forms made of spirally wrapped paper are well known in the above-mentioned industries. The tubular paper forms are normally set, at least partially, below grade in a hole. Soil is backfilled into the hole to stabilize the tube and the tube is then filled with flowable concrete. Once the concrete has set, the form is removed if the confines of the hole allow or the form is left on the concrete to deteriorate over time.

The paper tube forms are subject to damage if exposed to relatively wet conditions, such as being submersed into a hole with water seepage. Being subject to water damage, the time frame for completing the form pouring is limited to reduce the possibility of changing weather conditions or seepage of water over time.

Therefore, what is needed is a form tube that is usable in less than ideal building conditions.

Thermoplastic concrete form tubes are widely available and well suited for use in less than ideal building conditions. However, thermoplastic form tubes are generally limited to forms having a diameter of less than about 16 inches as thermoplastic concrete forms of larger diameter are susceptible to radial compression and collapse when subjected to backfill pressure.

Accordingly, a need exists for a thermoplastic form tube having a diameter greater than about 16 inches which can structurally withstand backfill pressure.

SUMMARY OF THE INVENTION

A first aspect of the invention is a single-piece thermoplastic inflexible concrete form tube at least 16 inches in diameter and at least 4 feet long with integrally formed fully encircling circumferentially continuous radially rigidifying ribs. The ribs are axially spaced along the full axial length of the tube between 10 and 36 inches apart center-to-center whereby any 3 foot length of the tube includes at least one radially rigidifying rib.

A second aspect of the invention is a method of forming a concrete column employing a concrete form tube in accordance with the first aspect of the invention. The method includes the steps of (a) excavating soil to form a hole, (b) inserting a first axial end of the concrete form tube into the hole, (c) backfilling the hole around the concrete form tube to create a stabilized concrete form tube, and (d) pouring concrete into the stabilized concrete form tube from a second longitudinal end of the concrete form tube.

DETAILED DESCRIPTION OF A PREFERRED EMBODIMENT

Nomenclature

10 Concrete Form Tube
10*a* Tube Length
11 First Axial End
12 Second Axial End
13 Wall of Tube
13*t* Wall Thickness
14 Interior Surface
15 Exterior Surface
20 Circumferentially Continuous Radially Rigidifying Ribs
24 Circumferential Shoulder
24*a* Axial Width of Circumferential Shoulder
24*r* Radial Depth of Circumferential Shoulder
25 Circumferential Groove
25*a* Axial Width of Circumferential Groove
25*r* Radial Depth of Circumferential Groove
$\mathbf{30}_n$ Axial Spacing Between Ribs
100 Soil
109 Hole in the Soil
110 Frost Line
a Axial Direction
r Radial Direction Construction The concrete forming tube 10 is an inflexible large diameter compression resistant tube 10. The tube 10 may be used to form pillars, posts, supports, piers, columns, shafts, pilings, or footings that serve as a foundation or prop for a structure or item such as outdoor sign posts, light poles, lamp posts, fence posts, pilings for decks and homes, play structures, gardens, and mailboxes. One of the more common uses of such large diameter concrete forming tubes 10 is pilings and footings which extend a substantial distance below grade. Therefore, the remainder of the discussion will be based upon a concrete forming tube 10 used to form below grade footings.

Figure 1:
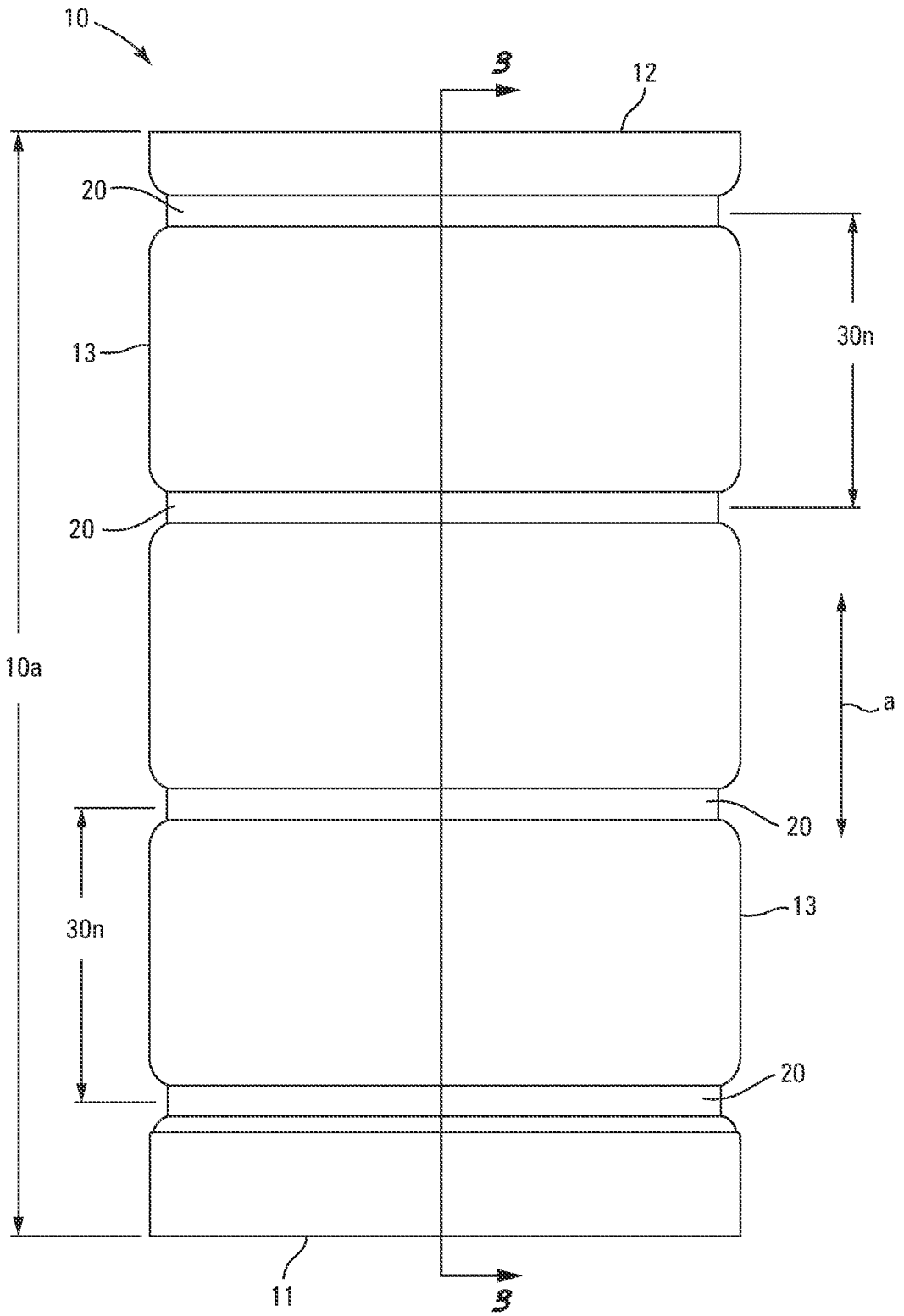
FIG. 1 is side view of one embodiment of the invention.
Figure 2:
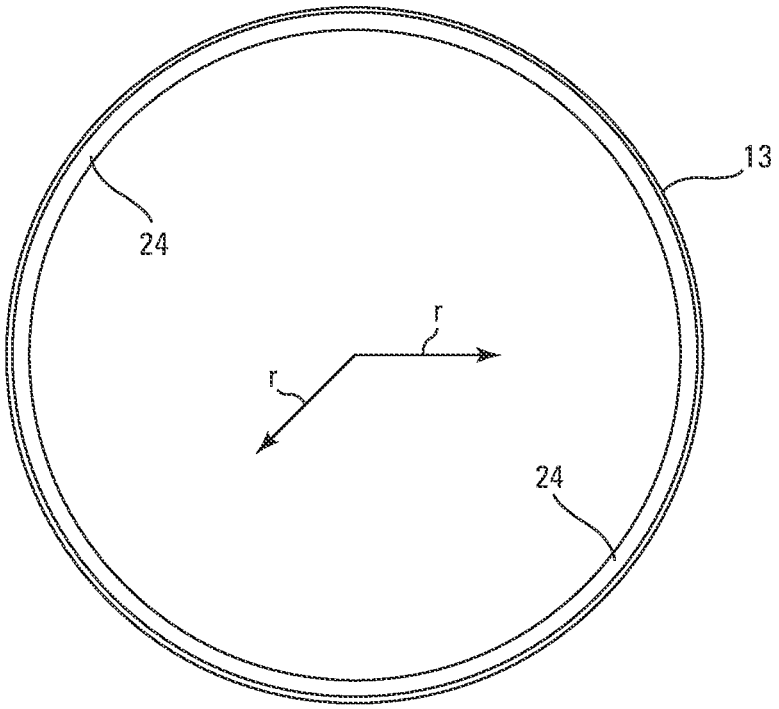
FIG. 2 is a top view of the invention depicted in FIG. 1.

As shown in FIGS. 1 and 2, one embodiment of the invention is a large diameter, inflexible, compression resistant concrete forming tube 10. The concrete forming tube 10 is made of thermoplastic such as polyethylene, polypropylene, polyethylene terephthalate, polyvinyl chloride, etc., with the preferred material comprising recyclable polyethylene. The use of a thermoplastic allows the concrete forming tube 10 to be used in wet areas as water will not penetrate through the sidewall 13 of the concrete forming tube 10 during pouring, a phenomena that can occur when using concrete forming tubes of other materials and is known to affect the quality of the concrete poured into the forming tube. The use of a material such as polyethylene also allows the concrete forming tube 10 to be set into place a period of time prior to pouring without underground water or weather conditions significantly affecting the quality of the concrete forming tube 10 itself. The use of a material such as polyethylene may also allow the concrete forming tube 10 to reduce the effects of frost heaving as materials such as polyethylene may decompose at a much slower rate than other materials such as paper.

The inflexible nature of the tube 10 is necessary to ensure that any concrete structure formed with the tube 10 is a vertically straight linear structure whereby the structure predominantly experiences a downward compressive force from a load placed upon the structure rather than a shear force. Concrete generally has excellent compressive strength but poor shear strength.

Figure 3:
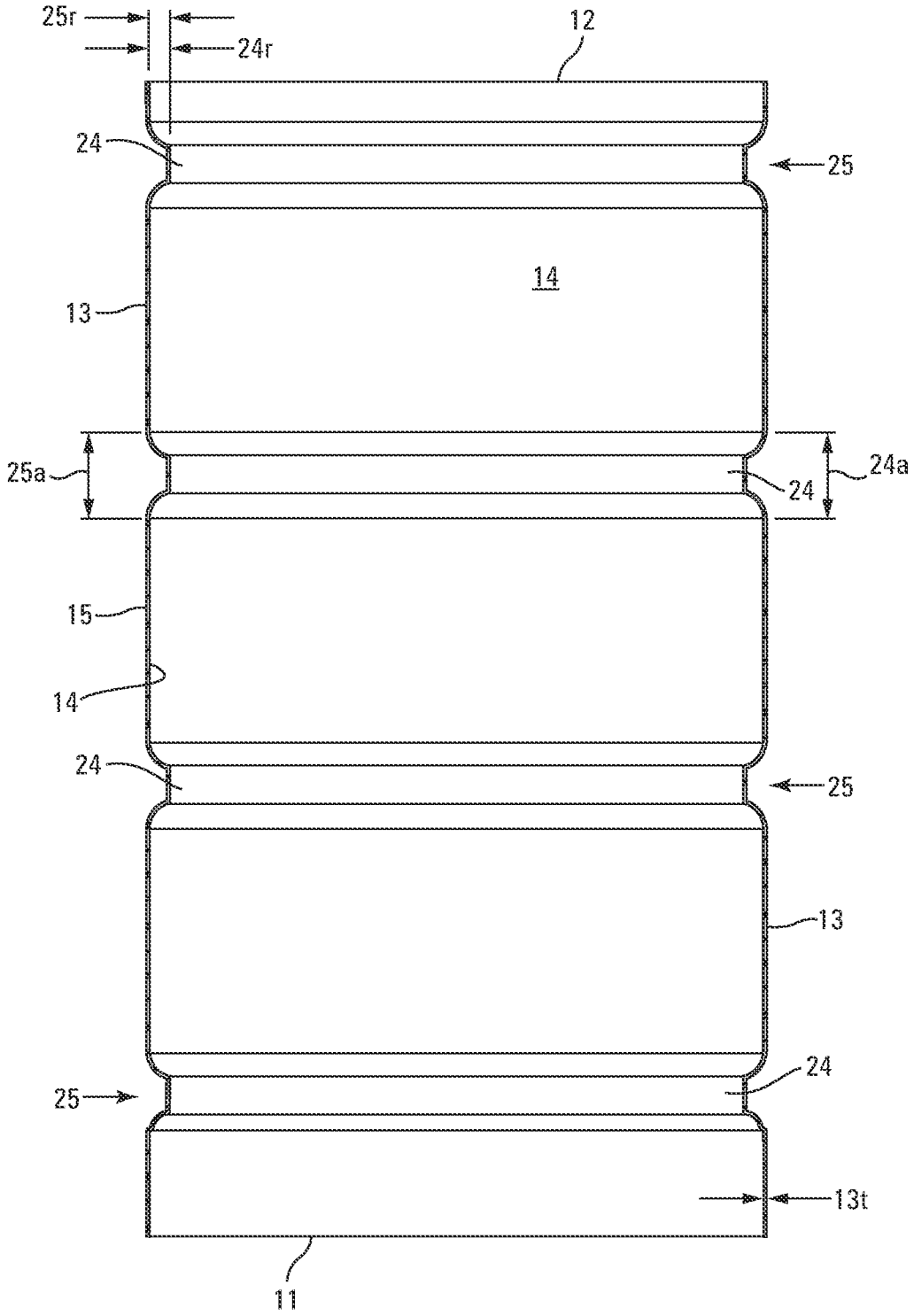
FIG. 3 is cross-sectional view of the invention depicted in FIG. 1 taken along line 3-3.

As shown in FIGS. 1-3, the concrete forming tube 10 has a sidewall 13 that extends a longitudinal length 10*a* from a first open axial end 11 to a second open axial end 12. The sidewall 13 defines an interior surface 14 and an exterior surface 15. The sidewall 13 has a thickness 13*t*. The concrete forming tube 10 is a large diameter tube (i) at least 4 feet long, preferably between 4 and 10 feet long, in the axial direction a, (ii) at least 16 inches in diameter, preferably between 16 and 36 inches in diameter, in the radial direction r, and (iii) preferably formed as a single-piece. Tubes 10 having a diameter of less than about 16 inches are not particularly susceptible to radial compression while tubes 10 having a diameter of greater than about 36 inches, even when formed in accordance with this invention, remain susceptible to radial compression.

The concrete forming tube 10 has a plurality of integrally formed fully encircling circumferentially continuous radially rigidifying ribs 20 axially a spaced between about 10 and 36 inches apart center-to-center along the full axial a length of the tube whereby any 3 foot length of the tube 10 includes at least one radially rigidifying rib 20. A spacing of less than about 10 inches begins to introduce unwelcome side-to-side bendability to the tube 10 akin to that observed with corrugated drainage pipe (i.e., the tube 10 starts to becomes flexible) absent a concomitant increase in compression resistance, while a spacing of greater than about 36 inchest begins to significantly reduce the compression resistance attributable to the ribs 20.

The range of preferred axial spacing 30*n* of the ribs 20 on a tube 10 is dependent upon the diameter of the tube 10, with the range of suitable spacing decreasing as the diameter increases. A preferred axial spacing 30*n* between radially rigidifying ribs 20 on a single tube 10 is between (1 ft)(2 ft/diameter of the tube 10) and (1 ft)(4 ft/diameter of the tube 10) with a minimum spacing of about 10 inches and a maximum spacing of about 36 inches. By way of example, following this preferred spacing algorithm a 16 inch tube should have ribs 20 spaced between 1.5 ft calculated as (1 ft)(24 inches/16 inches) and 3 ft calculated as (1 ft)(48 inches/16 inches) while a 36 inch tube should have ribs 20 spaced between 10 inches as (1 ft)(24 inches/36 inches)=8 inches and the minimum is 10 inches, and 1.3 ft calculated as (1 ft)(48 inches/36 inches).

Each radially rigidifying rib 20 creates a circumferential groove 25 in the exterior surface 15 of the tube 10 and a corresponding internally projecting circumferential shoulder 24 on the interior surface 14 of the tube 10. Each circumferential groove 25 preferably has an axial width 25*a* of between about 1 and 4 inches and projects a radial depth 25*r* of between 0.2 and 1 inch inward from the outer surface 15 of the tube 10, with each shoulder 24 having a corresponding axial width 24*a* and radial depth 24*r* projecting inward from the inner surface 14 of the tube 10.

The thickness 13*t* of the concrete forming tube 10 between the interior surface 14 and the exterior surface 15, may be any suitable thickness sufficient to hold the hydrostatic pressure of the concrete poured into the forming tube 10 without appreciable outward bulging of the sidewall 13 between ribs 20 and withstanding backfill compression pressure without appreciable inward bulging of the sidewall 13 between ribs 20. The preferred concrete forming tube 10 thickness is between about 0.05 and 0.2 inches with a unform thickness throughout except for the natural thinning that accompanies blow molding. The most preferred concrete forming tube thickness 13*t* is about one-eighth inch.

As shown in FIG. 3, the concrete forming tubes 10 may be connected together to provide a form with a longer longitudinal length. The forming tubes 10 may be connected using any suitable known means of connecting pieces of thermoplastic material. The preferred method of connection is a slide fit connector 20. The most preferred method of connection is an integrally formed slide fit connector 20 at one end 11 of the forming tube 10.

Use

Figure 4A:
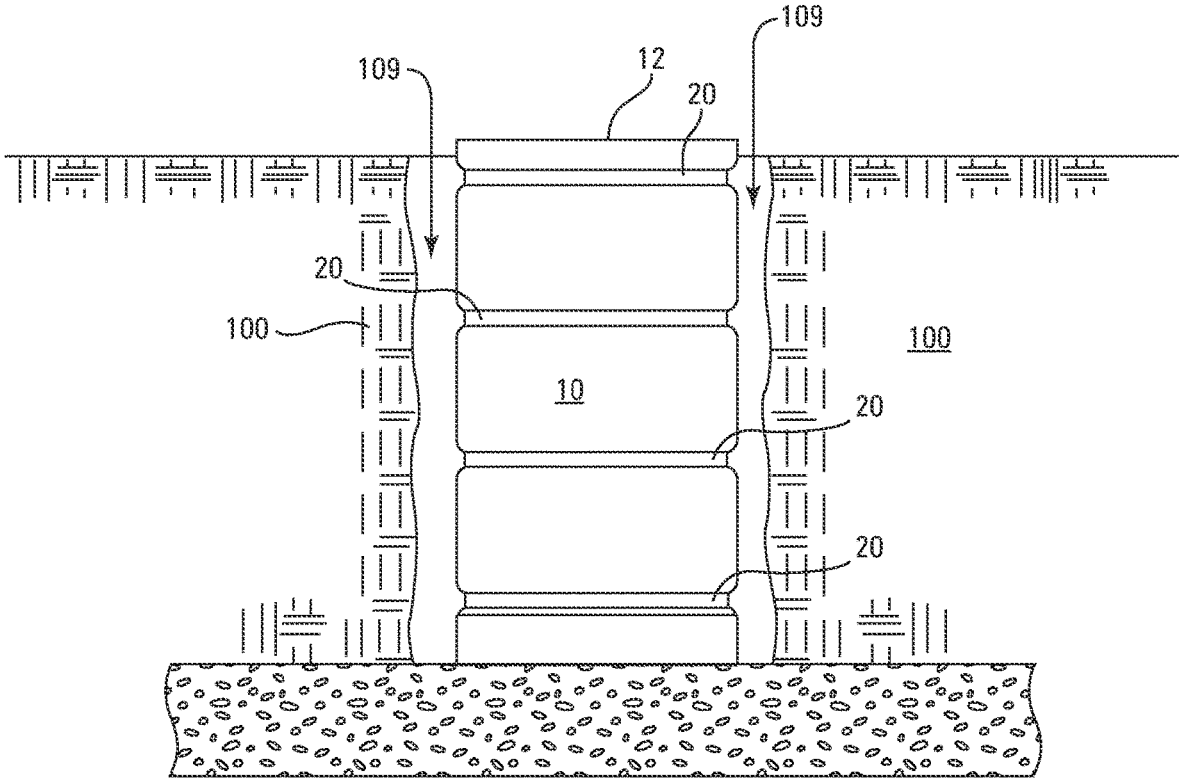
FIG. 4A is a side view of the invention depicted in FIG. 1 placed into an evacuated hole prior to backfilling.
Figure 4B:
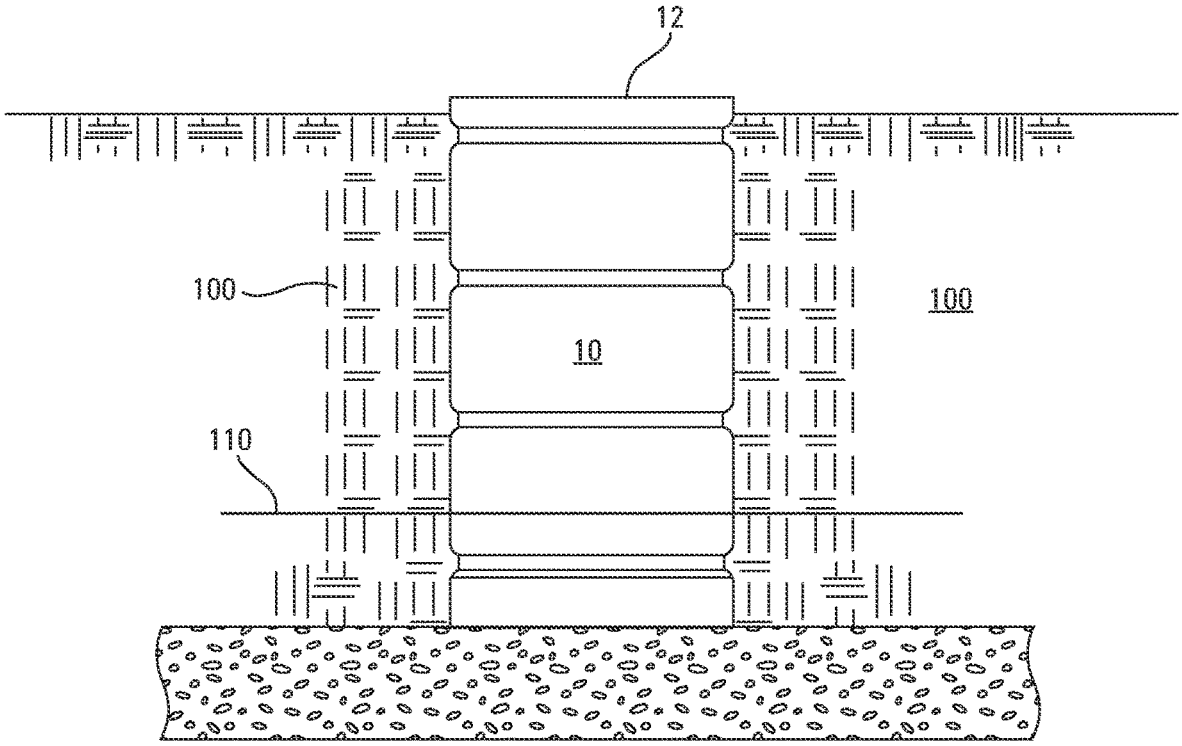
FIG. 4B is a side view of the invention depicted in FIG. 4A after backfilling.

Referring to FIGS. 4A and 4B, the concrete forming tube 10 can be used to form a concrete column (not shown) by (i) excavating soil 100 to form a hole 109, (ii) inserting the first axial end 11 of the concrete forming tube 10 into the hole 109, (iii) backfilling the hole 109 around the concrete forming tube 10 to create a stabilized concrete forming tube 10, and (iv) pouring concrete into the stabilized concrete forming tube 10 from the second longitudinal end 12 of the concrete forming tube 10. When forming a concrete column in climates subject to extended periods of below freezing air temperature the hole 109 is typically dug deep enough that the tube 10 extends well below the frost line 110.

The inwardly projecting shoulders 24 on the tube 10 prevent removal of the tube 10 after curing of the poured concrete.

What is claimed is:

1. A single-piece concrete form tube, comprising an inflexible thermoplastic tube at least 16 inches in diameter and at least 4 feet long in the axial direction, the tube open at both axial ends and having a plurality of separate and distinct integrally formed fully encircling circumferentially continuous radially rigidifying ribs axially spaced between about 10 and about 36 inches apart center-to-center along the full axial length of the tube whereby any 3 foot length of the tube includes at least one radially rigidifying rib.

2. The concrete form tube of claim 1 wherein each radially rigidifying rib defines a circumferential groove on the outside surface of the tube and a corresponding internally projecting circumferential shoulder on the inside of the tube.

3. The concrete form tube of claim 1 wherein the thermoplastic is selected from the group consisting of polyethylene, polypropylene, polyethylene terephthalate and polyvinyl chloride.

4. The concrete form tube of claim 1 wherein the tube is between 16 and 36 inches in diameter.

5. The concrete form tube of claim 1 wherein the tube is between 4 ft and 10 ft long.

6. The concrete form tube of claim 1 wherein the axial spacing between radially rigidifying ribs on a single tube is determined in accordance with the algorithm D=R/d wherein D is the axial spacing between radially rigidifying ribs in inches, R is a unitless numerical value between 2 and 4, and d is the diameter of the tube in inches, with endpoint limitations of a minimum axial spacing of 10 inches and a maximum axial spacing of 36 inches.

7. The concrete form tube of claim 2 wherein each circumferential groove projects a depth of between 0.2 and 1 inch inward from the outer surface of the tube and each shoulder projects an equal distance inward from the inner surface of the tube.

8. The concrete form tube of claim 7 wherein each circumferential radially rigidifying rib has a width in the axial direction of between 1 and 4 inches.

9. The concrete form tube of claim 1 wherein the tube has a wall thickness exclusive of the radially rigidifying ribs between 0.05 and 0.2 inches around the entire circumference of the tube and along the entire axial length of the tube.

10. The concrete form tube of claim 1 wherein the tube has a uniform wall thickness exclusive of the radially rigidifying ribs around the entire circumference and along the entire axial length of the tube.

11. The concrete form tube of claim 1 wherein the tube is a blow molded tube.

12. A method of forming a concrete column comprising the steps of (a) excavating soil to form a hole, (b) inserting a first axial end of a concrete form tube in accordance with claim 1 into the hole, (c) backfilling the hole around the concrete form tube to create a stabilized concrete form tube, and (d) pouring concrete into the stabilized concrete form tube from a second longitudinal end of the concrete form tube.

13. The method of claim 12 wherein the first axial end of the concrete form tube is positioned below the frost line.

* * * * *